United States Patent [19]

Steinman, Jr. et al.

[11] 4,006,285

[45] Feb. 1, 1977

[54] STARTER PLATE FOR ELECTRO SLAG REMELTING APPARATUS

[75] Inventors: Robert J. Steinman, Jr., Pittsburgh; John M. Pruss, Carnegie; Leonard G. Joseph, Pittsburgh, all of Pa.

[73] Assignee: Cyclops Corporation, Pittsburgh, Pa.

[22] Filed: Jan. 12, 1976

[21] Appl. No.: 648,041

[52] U.S. Cl. ..... 13/9 ES; 164/252

[51] Int. Cl.[2] ..... H05B 3/60

[58] Field of Search ..... 13/9, 9 ES; 164/52, 164/252

[56] References Cited

UNITED STATES PATENTS

| | | | |
|---|---|---|---|
| 3,670,089 | 6/1972 | Paton et al. | 13/9 |
| 3,715,201 | 2/1973 | Schlatter | 164/252 X |
| 3,734,164 | 5/1973 | Latash et al. | 164/252 |

*Primary Examiner*—R. N. Envall, Jr.
*Attorney, Agent, or Firm*—Webb, Burden, Robinson & Webb

[57] ABSTRACT

A starting plate is provided for electro slag remelting apparatus in which only a small surface area of the ingot bottom in the area adjacent the ingot perimeter is welded to the starting plate. The starting plate is either an annular disc in which the innermost surface area engages the ingot outer periphery or is an annular disc which is not in engagement with the ingot but which includes a plurality of spaced recesses to accommodate metal tabs that extend into the mold cavity to engage the ingot bottom along portions of its outer periphery. The starter plate is normally made of a steel or inexpensive ferrous alloy.

10 Claims, 9 Drawing Figures

STARTER PLATE FOR ELECTRO SLAG REMELTING APPARATUS

FIELD OF THE INVENTION

Our invention relates to electro slag remelting apparatus and, more particularly, to the starter plate which is employed between the remelted ingot and the copper base.

DESCRIPTION OF THE PRIOR ART

Industry is becoming increasingly aware of the electro slag remelting process to provide alloys for special applications where failure cannot be tolerated. The electro slag remelting process utilizes consumable electrodes of the particular chemistry desired for the final ingot. The process is initiated by placing a quantity of prepared refining slag on a mold base plate and then passing an electric current between the electrode and the base plate. The electrode remains immersed in the slag which is electrically conductive. The slag increases in temperature through electrical resistance heating until droplets of molten metal form and fall from the electrode through the slag to form a pool in the mold. As melting proceeds, the molten pool progressively solidifies thereby forming the remelted ingot. The slag offers the resistance to the passage of the electric current and thereby generates heat to melt the electrode. In addition, the slag protects the molten metal from oxidation and the composition of the slag assists in removing impurities from the molten metal droplets.

The electricity used is low voltage and high current. It is extremely important to maintain proper electrical contact between the electrode and the copper base so as to prevent arcing with the mold wall which then causes arc holes in the ingot and melting abnormalities within the ingot.

The present technology for starting electro slag remelts utilizes a starter plate which is placed on top of the water-cooled copper base. The starter plate is normally made of the same metal as that being remelted or it may just be a carbon steel plate. When a starter plate is used of the same composition as the metal being remelted, it becomes prohibitively expensive, especially in the case of nonferrous, high temperature alloys such as nickel or cobalt base alloys. Where a relatively inexpensive carbon steel plate is used, the problem of contamination arises and the elements within the remelt electrode may be thrown out of balance or the elements in the remelting ingot may go out of specification primarily at the bottom of the ingot.

A second problem that occurs is that as the remelted ingot solidifies, it may shrink away from the copper base. This then interrrupts the continuity of the electric contact and arcing may occur within the remelted ingot along the mold wall at or near the slag-metal interface causing abnormalities in the solidification pattern in the remelt ingot.

Some starter plates are firmly attached to the base to provide positive electrical contact throughout the entire melt. If made from a dissimilar metal, it can contaminate the remelt ingot. Another method is to weld a pad of the same metal being remelted to a starter plate made of a less expensive metal. However, this method not only increases the cost by using an expensive pad metal, but the additional cost of the welding operation further makes this method unattractive.

SUMMARY OF THE INVENTION

Our invention eliminates the need for providing starter plates of similar metals or the costly operation of welding a pad of the same metal to a starter plate. At the same time, contamination from the starter plate is kept at a minimum and there is positive electrical contact with the base throughout the melt.

This is accomplished by using a carbon steel annular disc-shaped starter plate between the copper base and the mold itself and which protrudes into the mold cavity a short distance sufficient to just weld to the remelt ingot and not enough to cause any appreciable contamination of the remelt ingot itself. This can be done by using a disc on a one time basis or can be done by using a reusable disc having a plurality of recesses which accommodate tabs which extend into the mold cavity and which form the only contact between the remelt ingot and the copper base. In the latter embodiment, an asbestos lining is provided between the tabs so as to eliminate damage to the disc and permit it to be reused.

DESCRIPTION OF THE PREFERRED EMBODIMENTS

Figure 1:
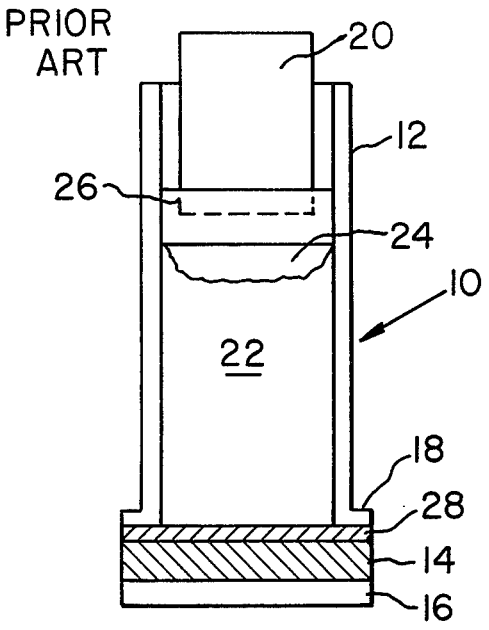
FIG. 1 is a diagramatic of the electro slag remelt apparatus showing the prior art starting plate.
Figure 2:
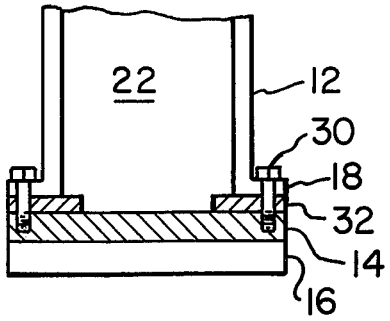
FIG. 2 is a broken away view of an electro slag remelt apparatus including our starter plate.
Figure 3:
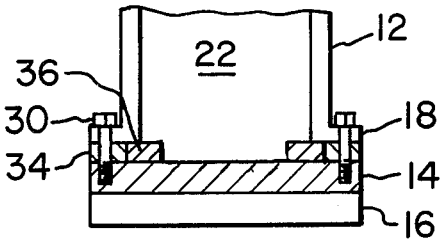
FIG. 3 is a broken away view of an electro slag remelt apparatus showing another embodiment of our starter plate.
Figure 4:
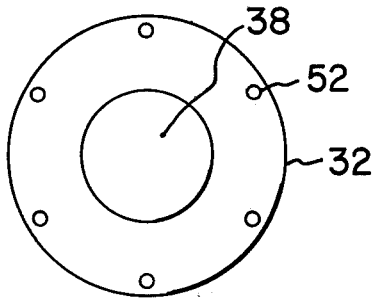
FIG. 4 is a plan view of the starter plate of FIG. 2.
Figure 5:
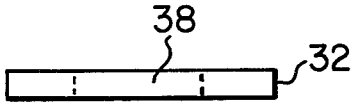
FIG. 5 is an elevation of the starter plate of FIG. 2.
Figure 6:
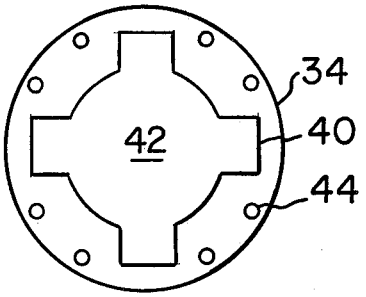
FIG. 6 is a plan view of the starter plate of FIG. 3.
Figure 7:
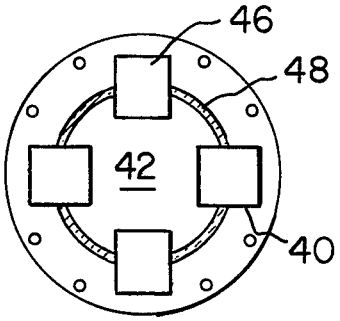
FIG. 7 is a plan view of the starter plate of FIG. 3 showing the metal tabs and asbestos lining.
Figure 8:
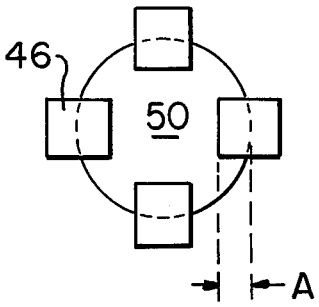
FIG. 8 is a bottom view of a remelt ingot showing the tabs welded thereto.

Standard electro slag remelt apparatus, generally designated 10, includes a mold 12 having a bottom flange 18 which rests on a base 14 normally made of copper, FIG. 1. Base 14 is water cooled by passing water through a lower section 16 of base 14. The mold 12 is illustrated as a static mold and it will be understood that a movable or ingot withdrawal mold may likewise be employed. An electrode 20 of the material to be remelted is inserted in the mold 12 and an arc is struck between the electrode 20 and the copper base 14. A starter plate 28 is positioned between the mold 12 and the copper base 14 and a slag 26 is placed thereupon. The starter plate 28 is normally of the configuration of the mold 12, e.g. square or round, and is made of a metal similar to the remelt ingot or of a plain carbon steel. The slag may either be dry, in which case it must be melted, or it may be liquid, in which case it must be fed into the mold 12, either from the top or bottom thereof. The electrode 20 is maintained within the molten slag 26 and as the electrode 20 is consumed, drops of molten metal 24 pass through the slag and thereafter solidify to form the remelt ingot 22. During this initial solidification of the molten metal 24, the remelt ingot 22 becomes welded to the starter plate 28, FIG. 1.

One form of our invention is illustrated in FIGS. 2, 4, 5 and 9. This form of starter plate is an annular disc 32 made of a carbon steel. Annular disc 32 includes a central opening 38 therethrough. Of course, should the mold be square or rectangular, the disc may be similarly configured, with the opening 38 conforming to the shape of the mold cavity. The annular disc 32 is placed on the copper base 14 and the mold flange 18 of mold 12 rests thereon. Where a satic mold is used, the mold flange 18 is bolted by bolts 30 to the copper base 14. In such an instance, the annular disc 32 is provided with a plurality of spaced bolt holes 52 so that the disc 32 is bolted between the mold flange 18 and the copper base 14.

Figure 9:
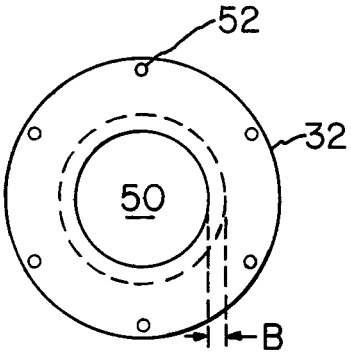
FIG. 9 is a bottom view of a remelt ingot showing the starter plate of FIG. 2 welded thereto.

The starter disc 32 extends into the mold cavity a short distance so that it underlies the bottom surface 50 of ingot 22 only in the area of the outer periphery of bottom surface 50, FIG. 9. The extent of this underlie, designated B in FIG. 9, can be emperically determined with the criteria being that there must be enough surface contact on the one hand to provide proper electrical contact between the ingot 22 and the copper base 14 and on the other hand the surface contact must be slight enough so as to not contaminate the remelt ingot itself. We have determined that this distance B should be between ½ inch to 1–⅛ inches for ingot sizes ranging from 16 inch squares to 21 inch rounds.

A second form of our invention is illustrated in FIGS. 3, 6, 7 and 8. There a disc 34 is provided having a central opening 42 therethrough. Extending radially outward from opening 42 into disc 34 are four recesses 40 spaced 90° apart. These recesses 40 accommodate carbon steel tabs 46 which are positioned within the recesses 40 and which extend into the opening 42 a short distance, FIG. 7. This assembly is bolted between the copper base 14 and the mold flange 18 through a plurality of bolt holes 44 provided in disc 34 as in the earlier embodiment. An asbestos lining 48 is positioned between the tabs 46 adjacent disc 34 so that the remelt ingot 22 will be completely out of contact with the disc 34. This allows for the disc 34 to be made out of a standard carbon steel and still be reusable with only the tabs being replaced. The four tabs 46 which engage the remelt ingot 22 must extend into the cavity of the mold 12 a distance sufficient to provide the necessary electrical contact without contaminating the remelted ingot analysis. It has been emperically determined that this distance, designated A in FIG. 8, should be 2–½ to 3 inches for ingot sizes ranging from 16 inch squares to 21 inch rounds.

The following data presented in Table 1 demonstrates the effectiveness of our starter plates over the full steel starter plates utilized heretofore.

TABLE 1

| Heat Identity | Type of Starter Plate | Comparison of Iron Analysis Fe % Before ESR | Fe% After ESR |
|---|---|---|---|
| A | Full steel plate | 1.88 | 4.56 |
| B | Annular disc | 1.72 | 1.70 |
| C | Annular disc | 1.50 | 1.53 |
| D | Starter tabs | 1.53 | 1.59 |
| E | Starter tabs | 1.53 | 1.58 |

All of the above heats were cobalt base superalloys having a 3% maximum iron specification. The iron analysis of the remelted round ingots was taken from the ingot bottom by first removing 1 inch from the ingot bottom and then sampling at the mid-radius position. It can be seen that the standard full carbon steel plate affected the iron analysis to the extent of being out of specification. Both embodiments of our invention had no appreciable effect on the iron analysis.

Both embodiments of our invention have been satisfactorily used on a variety of superalloy grades with static 16 inch square and 19 and 21 inch round molds. It is believed that the starter plates could be also used with movable or ingot withdrawal molds in which case only the starter plate would be bolted or clamped to the copper base. While both forms of our invention have proven successful, the carbon steel tab embodiment is the most economical since the disc is reusable and only the tabs need to be replaced. Under certain conditions such as where the tabs are only lightly welded to the ingot, the tabs can also be reused.

We claim:

1. In an electro slag remelting apparatus including an ingot mold having a central cavity, a base to support a bottom surface of a remelt ingot of a first metal, and a consumable electrode extending into said cavity to form said ingot, the improvement comprising a starting plate means positioned between the base and the ingot, said starting plate means having a central opening therethrough and extending inward from the ingot mold a short distance into the cavity so as to contact at least a portion of the bottom surface in the area adjacent the perimeter thereof.

2. The apparatus of claim 1, said starting plate means comprising a disc, said disc extending inward from the mold a short distance so as to contact the entire perimeter of the bottom surface.

3. The apparatus of claim 2, said disc being annular.

4. The apparatus of claim 2, said disc being connected to both the mold and the base in an area out of contact with the ingot.

5. The apparatus of claim 2, said distance being approximately ½ to ⅛ inches.

6. The apparatus of claim 1, said starting plate means in contact with the ingot being of a second metal different from said first metal.

7. The apparatus of claim 1, said starting plate means comprising a member with a plurality of spaced recesses extending outward into the member from the central opening and a metal tab retained in each recess and extending inward into the opening and mold cavity, only said tabs being in contact with the ingot bottom surface.

8. The apparatus of claim 7, said member including four recesses spaced 90° apart, said tabs extending inward approximately 2½ to 3 inches.

9. The apparatus of claim 7, including asbestos packing positioned adjacent the member and between the tabs.

10. In an electro slag remelting apparatus for producing a nonferrous base superalloy ingot including an ingot mold having a central cavity, a base to support said ingot and a consumable electrode extending into said cavity to form said ingot, the improvement comprising an annular starting plate positioned adjacent the base and out of contact with said ingot, said plate having a plurality of spaced recesses extending outward from a central opening therethrough and a steel tab retained in each recess and extending inward into the opening, said tabs being in contact with the base and the nonferrous alloy ingot in the area of the ingot bottom periphery.

* * * * *

UNITED STATES PATENT OFFICE

CERTIFICATE OF CORRECTION

PATENT NO. : 4,006,285

DATED : February 1, 1977

INVENTOR(S) : R. J. Steinman, Jr., et al.

It is certified that error appears in the above-identified patent and that said Letters Patent are hereby corrected as shown below:

Column 3 Line 9 "satic" should read --static--.
Column 3 Line 19 - B - should read --"B"--.
Column 3 Line 25 -B- should read --"B"--.
Column 3 Line 48 - A- should read --"A"--.

Claim 5 - Column 4 Line 39 "1/8 inches" should read --1-1/8 inches--.

Signed and Sealed this

Twelfth Day of April 1977

[SEAL]

*Attest:*

RUTH C. MASON
*Attesting Officer*

C. MARSHALL DANN
*Commissioner of Patents and Trademarks*